US005311922A

United States Patent [19]

Streubel

[11] Patent Number: 5,311,922

[45] Date of Patent: May 17, 1994

[54] MOLD FOR CONTINUOUSLY CASTING STEEL STRIP

[75] Inventor: Hans Streubel, Erkrath, Fed. Rep. of Germany

[73] Assignee: SMS Schloemann-Siemag Aktiengesellschaft, Dusseldorf, Fed. Rep. of Germany

[21] Appl. No.: 3,552

[22] Filed: Jan. 13, 1993

[30] Foreign Application Priority Data

Jan. 20, 1992 [DE] Fed. Rep. of Germany ..... 4201363

[51] Int. Cl.[5] ..... B22D 11/04

[52] U.S. Cl. ..... 164/418; 164/459

[58] Field of Search ..... 164/418, 459

[56] References Cited

U.S. PATENT DOCUMENTS 4,811,779 3/1989 Streubel ..... 164/418

4,834,167 5/1989 Streubel ..... 164/418

FOREIGN PATENT DOCUMENTS 0286910 3/1992 European Pat. Off. .

3907351 9/1990 Fed. Rep. of Germany .

*Primary Examiner*—Kuang Y. Lin

*Attorney, Agent, or Firm*—Herbert Dubno; Andrew Wilford

[57] ABSTRACT

In a continuous-casting mold for strip steel relatively long side walls have inner surfaces bridged by and forming an upwardly open passage with relatively short end walls, and each side wall has starting at an upper edge an inwardly open recess having an inwardly concave central portion joined at respective upright lines with a pair of flanking inwardly convex side portions. The portions having respective radii of curvature. The radius of curvature of the central portion increases continuously from the upper edge to a straight line at a lower edge of the respective recess and the radius of curvature of each outer portion is substantially constant within at least 100 mm of the upper edge of the respective side wall and may be constant over the entire vertical length of each side portion.

2 Claims, 3 Drawing Sheets

MOLD FOR CONTINUOUSLY CASTING STEEL STRIP

FIELD OF THE INVENTION

The present invention relates the continuous casting of a steel workpiece, here termed a strip. More particularly this invention concerns a mold for continuously casting steel strip.

BACKGROUND OF THE INVENTION

In continuous casting, liquid metal is poured into the upper end of and withdrawn from the lower end of a vertically throughgoing cavity of a mold that is cooled so that before the metal reaches the lower end of the cavity the strand shell is strong enough to form a coherent shape that is pulled from the mold as a continuous strand. When steel strip is being formed the mold has two relatively long sides bridged at their ends by two relatively short ends. Granular additives are added at the top of the mold to form a protective and lubricating slag.

In order to make the faces of the strip as smooth as possible it has been suggested in European patent application 1,149,734 and in my earlier U.S. Pat. No. 4,721,151 to flare the mold cavity at an upper central region where the liquid metal is introduced into the mold, that is shape the cavity in this region so its flow cross section decreases downward. In the center of the top of the cavity the inside surfaces of the sides of the mold are cut back to achieve this effect. End regions of these inner surfaces are parallel to each other so that the tapering only actually exists at the upper region of the mold cavity in its center.

Such a system somewhat reduces surface imperfections in the steel strip produced, but still leaves a substantial number of flaws, particularly near the edges of the strip. The improvement is evidently caused by entraining a small amount of the slag from atop the melt down along the sides of the mold. The resultant lubrication substantially eliminates wavy marks on the faces of the steel strip thus produced.

Accordingly in my U.S. Pat. No. 4,834,167 I propose a system where the inner surfaces of the long sides are each formed by a planar lower portion wholly below the level, a central portion offset inward from the end walls and extending from the respective lower portion up above the level, a pair of planar intermediate portions coplanar with the respective lower portion, wholly below the level, and each extending between the respective central portion and a respective one of the end walls, and a pair of planar upper portions coplanar with each other, extending from the respective intermediate portions upward past the level, and flanking the respective central portion above the respective intermediate portions. The upper portions of each of the side walls diverge upward from and form a reflex angle of between 1' and 3' with a symmetry plane bisecting the side walls. The lower portions extend parallel to each other the full width of the mold between the end walls and the central portions flank the lower end of the tube pouring liquid steel into the mold and diverge upward. The end walls are of uniform horizontal width below the upper portions and are of a width increasing uniformly upward along the upper portions.

It has further been suggested in German patent document 3,907,351 of H. Grothe to form the recess of each upper central region as a curved pocket having an inwardly concave central portion flanked by two inwardly convex side portions. The radii of curvature of these portions increase in the downward flow direction through the mold until the curved portions become flat with an effective radius of infinity and merge with the planar inner face of the wide wall. This continuously deforms the incoming strand of molten steel so as to reduce friction between the strand shell and the mold in the critical upper region.

In U.S. Pat. No. 4,811,779 a mold is described whose enlarged upper region has an upper portion that extends parallel to the side walls to produce opposite deformation in the strand.

OBJECTS OF THE INVENTION

It is therefore an object of the present invention to provide an improved continuous-casting mold.

Another object is the provision of such an improved continuous-casting mold which overcomes the above-given disadvantages, that is which produces a flaw-free steel strip.

SUMMARY OF THE INVENTION

The instant invention is an improvement in a continuous-casting mold for strip steel wherein relatively long side walls have inner surfaces bridged by and forming an upwardly open passage with relatively short end walls, and wherein each side wall has starting at an upper edge an inwardly open recess having an inwardly concave central portion joined at respective upright lines with a pair of flanking inwardly convex side portions. Each side portion has an outer portion joined at respective upright lines with the central portion. The portions having respective radii of curvature. The improvement according to the invention is that the radius of curvature of each outer portion is substantially constant within at least 100 mm of the upper edge of the respective side wall.

In this manner the still thin strand shell beneath the melt surface is guided without deformation to a larger surface portion.

According to a further feature of the invention each recess has a lower edge and the radius of curvature of each outer portion is substantially constant from the upper edge to the lower edge of the respective recess.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
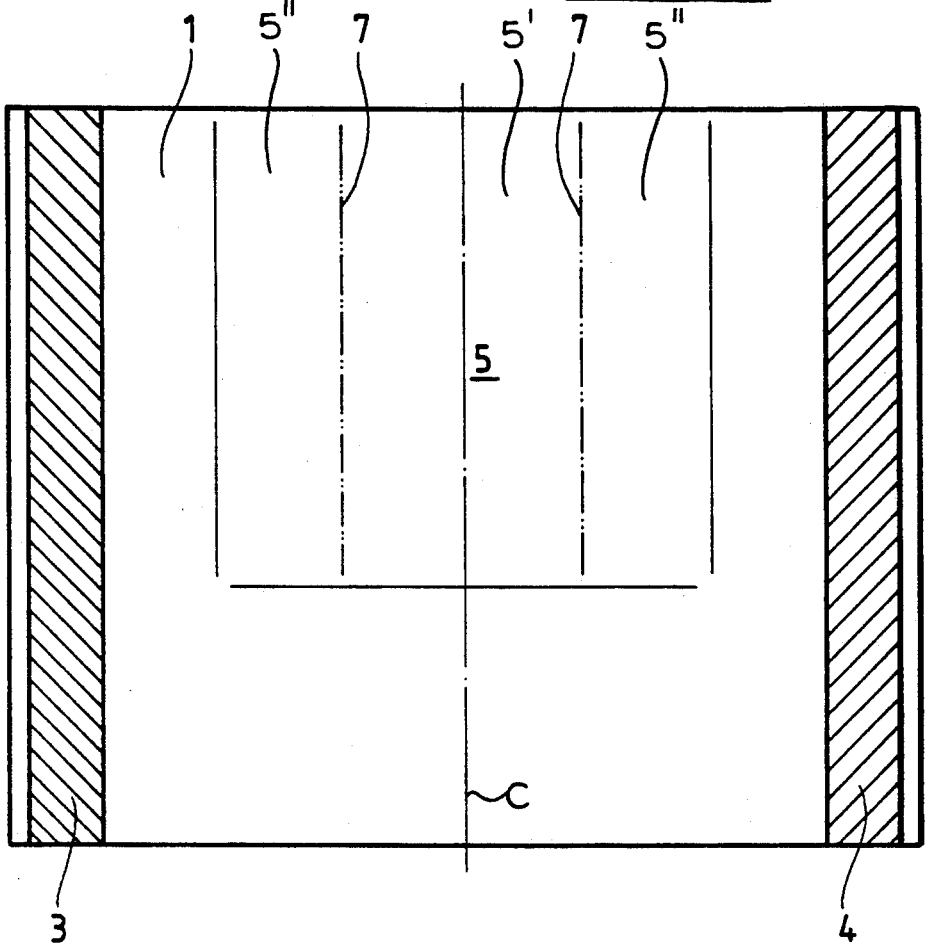
FIG.1 PRIOR ART
FIG. 1 is a vertical section through a prior-art mold.
Figure 2:
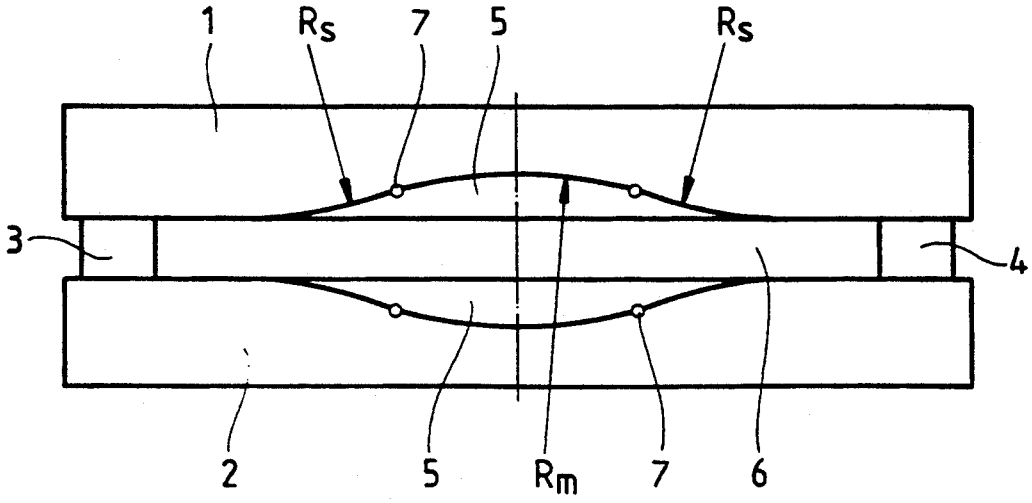
FIG.2 PRIOR ART
FIG. 2 is a top view of the prior-art mold.

As seen in FIGS. 1 and 2 a standard mold has a pair of wide-wall side plates 1 and 2 bridged by a pair of narrow-wall end plates 3 and 4 together defining a vertically throughgoing basically rectangular-section passage 6 having a vertical longitudinal centerline C. The side-wall plates 1 and 2 are formed with identical upwardly open cutouts 5 each subdivided along a pair of straight vertical lines into an inwardly concave center portion 5' and a pair of flanking inwardly convex side portions 5'' having respective radii of curvature $R_m$ and $R_s$ that increase downward as seen in FIG. 1.

Figure 3:
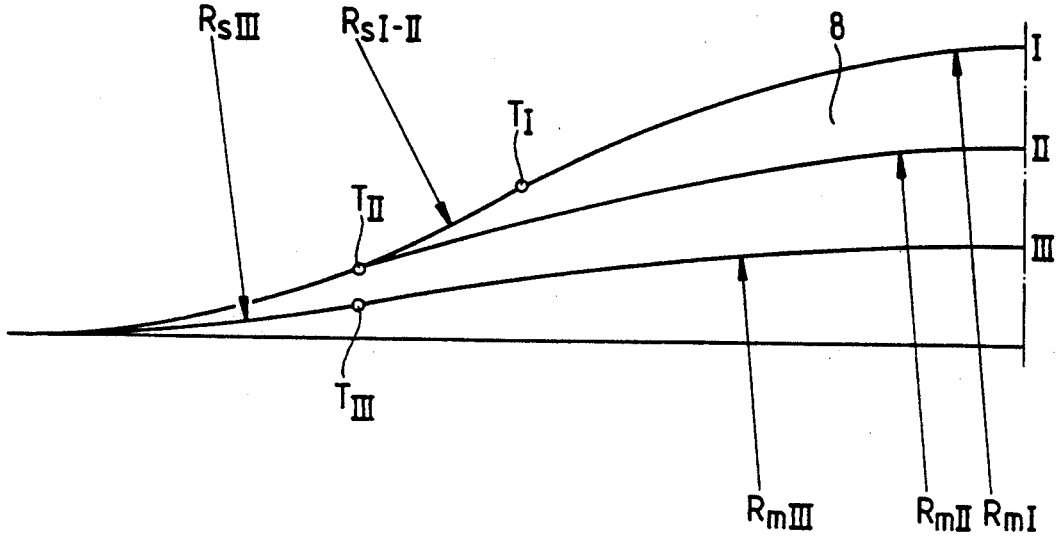
FIG. 3 is a diagram illustrating the construction of a mold according to the invention.
Figure 4:
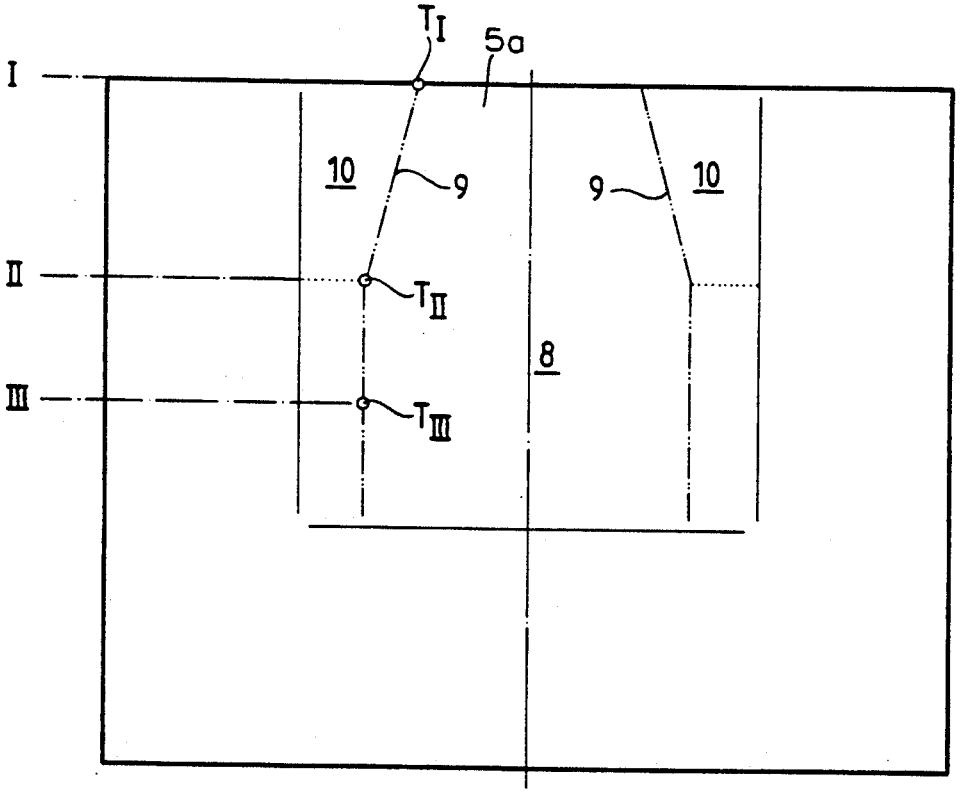
FIG. 4 is a side view of a mold part constructed according to FIG. 3.

In the system of our invention as shown in FIGS. 3 and 4 the cutout 5*a* is subdivided by lines 9 into a central portion 8 and two side portions 10. The lines 9 are not straight but instead run from a point $T_I$ at a top plane I at an angle to the centerline C to a point $T_{II}$ at a middle plane II and then parallel to the centerline C to a point $T_{III}$ at a plane III above the level where the cutout 5*a* merges with the planar inner face of the mold 1-4.

The central portion 8 has a radius of curvature $R_{mI}$ at the upper plane I which increases continuously to $R_{mII}$ at the plane II and $R_{mIII}$ at plane III and gets finally straight and merges with the planar inner face. The outer portions 10 each have a radius of curvature $R_{sI}$ at the plane I and an identical radius $R_{sII}$ at the plane II, then increasing continuously to a radius $R_{sII}$ at the plane III and finally becomes a straight line at the beginning of the planar inner face. In the regions 10 above the plane II the radius of curvature is constant, therefore the strand shell will not be deformed.

Figure 5:
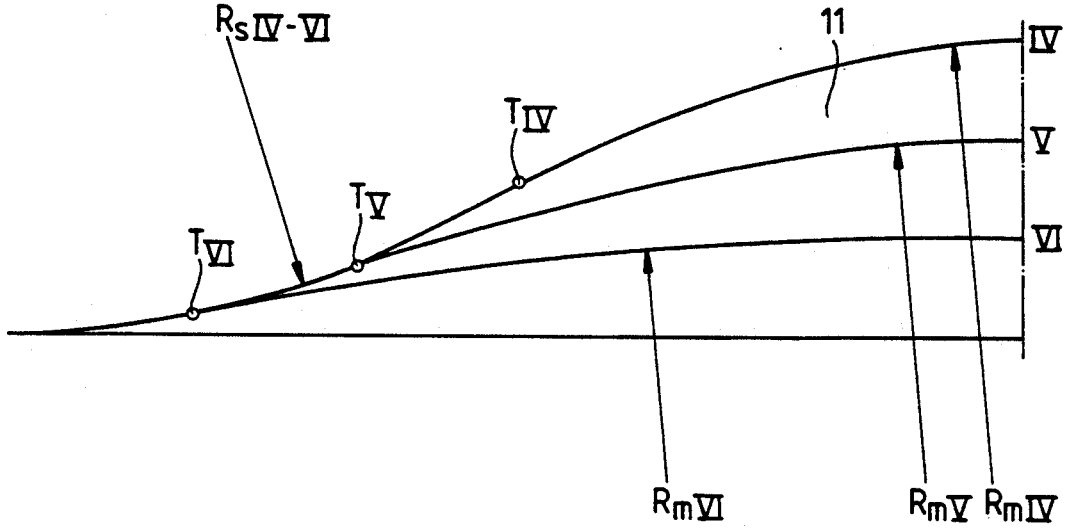
FIGS. 5 and 6 are views like FIGS. 3 and 4, respectively, showing another mold according to the invention.
Figure 6:
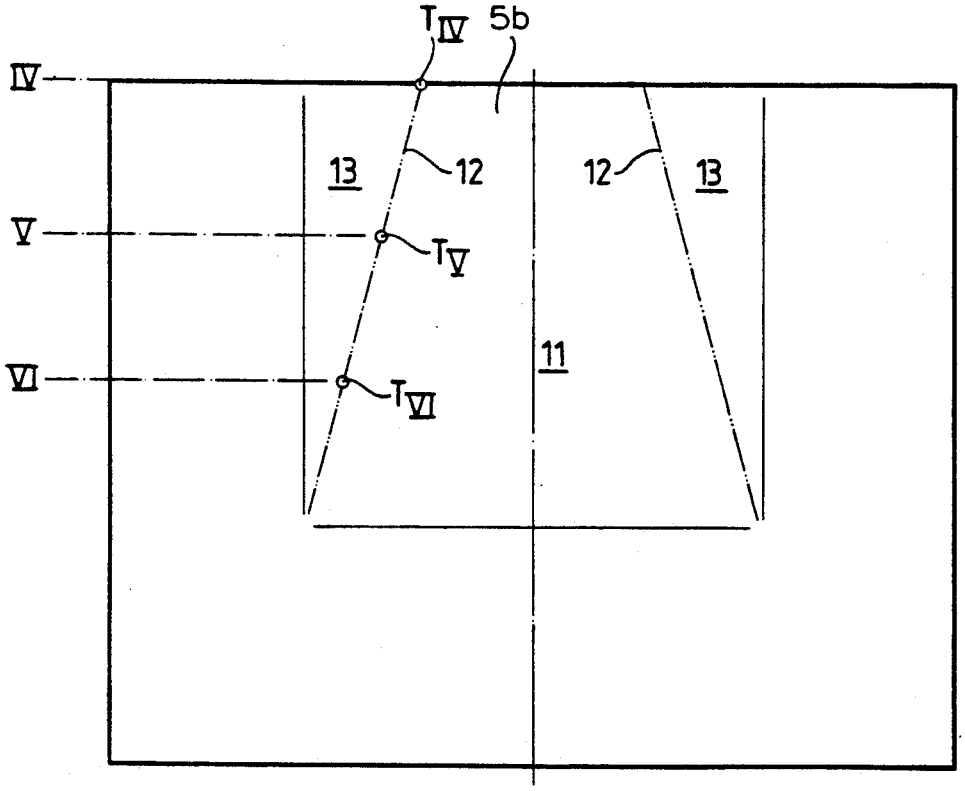

In the arrangement of FIGS. 5 and 6 the cutout 5*b* is subdivided by straight lines 12 into inner and outer portions 11 and 13, respectively. The central region 11 has a radius of curvature increasing continuously from $R_{mIV}$ through $R_{mV}$ to $R_{mVI}$ at planes IV, V, and VI to a straight line at the planar inner face, while the outer regions 13 have identical radii of curvature $R_{sIV}$, $R_{sV}$, and $R_{sVI}$ at the planes IV, V, and VI, respectively. The strand shell is once again not deformed in the regions 13.

I claim:

1. In a continuous-casting mold for strip steel wherein relatively long side walls have inner surfaces bridged by and forming an upwardly open passage with relatively short end walls, and wherein each side wall has starting at an upper edge an inwardly open recess having an inwardly concave central portion joined at respective upright lines with a pair of flanking inwardly convex side portions, each of said side portions has an outer portion joined at respective upright lines with said central portion, the portions having respective radii of curvature, the improvement wherein:

the radius of curvature of the central portion increases continuously from the upper edge to a straight line at a lower edge of the respective recess, and the radius of curvature of each outer portion is substantially constant within at least 100 mm of the upper edge of the respective side wall.

2. The improved continuous-casting mold defined in claim 1 wherein each recess has a lower edge and the radius of curvature of each outer portion is substantially constant from the upper edge to the lower edge of the respective recess.

* * * * *